US006680706B2

(12) United States Patent
Loftus, Jr. et al.

(10) Patent No.: US 6,680,706 B2
(45) Date of Patent: Jan. 20, 2004

(54) TELEMATIC ANTENNA VORTEX GENERATOR

(75) Inventors: James A. Loftus, Jr., Marysville, OH (US); Jerome M. Kowalik, Plain City, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/039,398

(22) Filed: Jan. 4, 2002

(65) Prior Publication Data

US 2003/0128170 A1 Jul. 10, 2003

(51) Int. Cl.[7] ..... H01Q 1/32
(52) U.S. Cl. ..... 343/715; 343/900; 343/895
(58) Field of Search ..... 343/713, 715, 343/711, 895, 900, 702

(56) References Cited

U.S. PATENT DOCUMENTS

| | | | | |
|---|---|---|---|---|
| 4,109,224 A | | 8/1978 | Liautaud | 336/192 |
| 4,163,981 A | | 8/1979 | Wilson | 343/715 |
| 4,255,735 A | | 3/1981 | Liautaud | 336/192 |
| 4,379,298 A | | 4/1983 | Vincent et al. | 343/895 |
| 4,792,944 A | | 12/1988 | Takahashi et al. | 370/84 |
| 5,151,711 A | | 9/1992 | Taguchi | 343/715 |
| D341,362 S | | 11/1993 | Taguchi | D14/234 |
| D341,835 S | | 11/1993 | Taguchi | D14/230 |
| 5,258,765 A | | 11/1993 | Dörrie et al. | 343/722 |
| 5,751,251 A | | 5/1998 | Hutchinson | 343/715 |
| 6,100,852 A | * | 8/2000 | Calearo | 343/715 |
| 6,222,491 B1 | | 4/2001 | Blom | 343/702 |
| 6,331,838 B1 | * | 12/2001 | Scott et al. | 343/715 |
| 6,356,237 B1 | * | 3/2002 | Kim | 343/713 |
| 6,366,249 B1 | * | 4/2002 | Jones et al. | 343/715 |
| 6,486,842 B2 | * | 11/2002 | Wang | 343/715 |
| 6,486,843 B2 | * | 11/2002 | Wang et al. | 343/715 |

* cited by examiner

*Primary Examiner*—Hoanganh Le
*Assistant Examiner*—Shih-Chao Chen
(74) *Attorney, Agent, or Firm*—Dinsmore & Shohl LLP

(57) ABSTRACT

A telematic vehicle antenna for dampening low frequency vibrations includes a shaft adapted to be mounted on a vehicle, wherein the shaft has a longitudinal axis and an outer surface, the outer surface has a configuration that surrounds and extends generally parallel to the longitudinal axis, and the diameter of the configuration defines the diameter of the shaft. The antenna further comprises a conductor substantially enclosed by the outer surface and an air turbulence generator in contact with the outer surface for dampening vibrations transmitted to a vehicle by the shaft, wherein the air turbulence generator extends helically in a direction generally parallel to the longitudinal axis, and the air turbulence generator extends radially outwardly from the outer surface of the shaft by a distance greater than or equal to about 10% of the diameter of the shaft. A method of dampening low frequency vibrations associated with telematic antennas is also disclosed.

21 Claims, 5 Drawing Sheets

TELEMATIC ANTENNA VORTEX GENERATOR

TECHNICAL FIELD

This invention relates generally to antennas, and more particularly to an apparatus and method for dampening low frequency vibrations associated with the use of telematic antennas on motor vehicles.

BACKGROUND

Over the past few decades, automobile technology has improved dramatically, particularly in the areas of consumer comfort, convenience, and safety. As automobile manufacturers continually strive to make automobiles more comfortable for passengers, a key area of concern is the level of noise and vibration present within passenger compartments. Many factors contribute to these noise and vibration levels, including the mounting of the engine, the nature of any insulation within the engine compartment, the type and balancing of the tires, and the ability for wind to pass freely over the external profile of the automobile. Such factors are thus carefully designed so as to ensure the most comfortable environment possible within the passenger compartment.

One example of a device that affects the ability for wind to pass freely over the external profile of an automobile is an antenna used for wireless communications. When such an antenna is present upon the external profile of an automobile, wind resistance is generated and a discernable noise and/or vibration may resultantly develop when the automobile travels at high rates of speed or is otherwise subject to strong winds. This noise and/or vibration is often detectable and might prove annoying or distracting to persons within the automobile's passenger compartment (hereafter "occupants"). As a result, this generation of noise and/or vibration may resultantly prevent the occupants from enjoying the very communications that such antennas were designed to facilitate.

The type of noise and/or vibration generated by an antenna depends in large part upon the antenna's shape. Although there are now many shapes of antennas being used on automobiles, perhaps the most common antenna traditionally used has a rod-shape. A rod-shaped antenna is typically relatively long and quite slender, and is often referred to as a "mast" antenna. For example, an automobile's AM/FM radio antenna is typically a rod-shaped antenna having a length of between about 0.3 meters and about 1 meter and a diameter of less than about 10 millimeters. Some rod-shaped antennas might also include a phase coil disposed along the rod.

Certain rod-shaped antennas have been identified as generating high frequency whistling noises, such as in the 1,000 Hz to 10,000 Hz range, when the antenna is attached to an automobile moving at high speeds or is otherwise subject to strong winds. These whistling noises are said to interfere with occupants' comfort within the automobile, particularly with regard to such activities as cellular telephone conversations. Various patents have disclosed structures for eliminating this whistling noise. For example, Taguchi (U.S. Pat. No. 5,151,711) teaches the addition to a rod-shaped antenna of a hollow cylindrical member including a plurality of hollow cylindrical units, wherein the cylindrical member has one or more ridges to generate a turbulent flow of air around the antenna and resultantly eliminate the high frequency whistling caused by strong winds. However, such patents are deficient in many areas, particularly with regard to eliminating different types of wind noises, such as those created by antennas not having the traditional rod-shape.

As technological advances in wireless automotive communication systems continually progress, antennas not having the traditional rod-shape are becoming more commonplace. For example, because many of these recent advances, such as the Global Positioning System ("GPS"), satellite radio, and advanced cellular (e.g.: wireless) telephones, typically transmit and receive relatively high frequency digital radio waves having correspondingly short wavelengths, these systems are able to effectively communicate using considerably shorter antennas than those rod-shaped antennas traditionally used by other less sophisticated communication systems. One such alternative to the traditional rod-shaped antenna involves an antenna incorporating an extremely short but relatively wide shaft, wherein the overall length of the shaft is less than about ten times the diameter of the shaft, hence giving the antenna a "finger-shape". Because of its unique configuration, the finger-shaped antenna does not typically generate the high frequency whistling noises that are typically associated with rod-shaped antennas when subjected to strong winds. Rather, the finger-shaped antennas often generate an equally annoying and disturbing low frequency vibration when subjected to strong winds. Because rod-shaped antennas tend to whistle at high frequencies rather than vibrate at low frequencies, and because finger-shaped antennas are physically quite different from rod-shaped antennas, a creative solution is necessary to dampen the low frequency vibrations common to finger-shaped antennas. Although the shafts of some finger-shaped telematic antennas have been modified to include indentations such as grooves, slots, dimples, or the like, presumably for aesthetic purposes, none of these prior art designs functions to reduce low frequency vibrations. To the contrary, such designs generate even greater amplitudes of low frequency vibrations when subjected to strong winds. It is for these reasons that the solution of the present invention has come to light.

In accordance with the present invention, a finger-shaped antenna is affixed to an exterior surface of an automobile. The shaft of the finger-shaped antenna is fitted with one or more turbulence generators specifically configured and arranged to dampen any low frequency vibrations that would otherwise be generated by the antenna when exposed to strong winds. The one or more turbulence generators can, in one embodiment of the present invention, constitute an outwardly directed protrusion from the outer surface of the shaft, wherein the protrusion extends helically in a direction generally parallel to the longitudinal axis of the shaft. This protrusion is operable to generate air turbulence and resultantly dampen the problematic low frequency vibrations of the finger-shaped antenna. The present invention therefore enables the use of the finger-shaped antenna, and accordingly any associated communication devices, without any adverse impact on the comfort of the automobile's occupants.

The present invention is not limited to the finger-shaped antenna, but is equally applicable to a multitude of other antennas or objects that generate noise and/or vibrations when exposed to strong winds, such as those winds present surrounding an exterior surface of an automobile, truck, aircraft, motorcycle, all terrain vehicle ("ATV"), watercraft, building, or other such location. Furthermore, the present invention relates not only to antennas for GPS, satellite radio, and advanced cellular telephones, but also to antennas for any other type of communication system.

SUMMARY OF THE INVENTION

Accordingly, it is an object of the present invention to reduce low frequency vibrations associated with the use of telematic antennas on motor vehicles.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention defined herein, an apparatus and method is provided for enabling the dampening of low frequency vibrations associated with telematic antennas on motor vehicles. The telematic antenna with low frequency dampening for use on a motor vehicle comprises a shaft adapted to be mounted on a vehicle, the shaft having a longitudinal axis and an outer surface, the outer surface having a configuration that surrounds and extends generally parallel to the longitudinal axis, wherein the diameter of the configuration defines the diameter of the shaft. The antenna further comprises a conductor, the conductor substantially enclosed by the outer surface, and an air turbulence generator in contact with the outer surface for dampening vibrations transmitted to a vehicle by the shaft, the air turbulence generator extending helically in a direction generally parallel to the longitudinal axis, and the air turbulence generator extending radially outwardly from the outer surface of the shaft by a distance greater than or equal to about 10% of the diameter of the shaft.

In accordance with one aspect of the invention, the air turbulence generator extends radially outwardly from the outer surface of the shaft by a distance between about 10% and about 20% of the diameter of the shaft.

In another aspect of the invention, the air turbulence generator extends radially outwardly from the outer surface of the shaft by a distance of about 10% of the diameter of the shaft.

In yet another aspect of the invention, the air turbulence generator extends substantially continuously along the shaft.

In accordance with still a further aspect of the invention, the cross-sectional diameter of the air turbulence generator in a direction normal to the radial extension of the air turbulence generator and normal to the helical extension of the air turbulence generator is substantially equal to the distance of radial extension by the air turbulence generator outward from the shaft.

In still another aspect of the invention, the helical projection of the air turbulence generator defines a plurality of windings of the air turbulence generator around the shaft, wherein the distance between the cross-sectional centers of two adjacent windings defines the pitch.

In yet another aspect of the invention, the pitch is substantially uniform among all adjacent windings of the air turbulence generator.

In accordance with another aspect of the invention, the pitch is between about 5 millimeters and about 10 millimeters.

In accordance with still another aspect of the invention, the pitch is about 5 millimeters.

In a further aspect of the invention, the air turbulence generator is integral with the shaft.

In still a further aspect of the invention, the configuration is generally cylindrical.

In accordance with yet another aspect of the invention, the air turbulence generator is electrically isolated from the conductor.

In another aspect of the invention, the air turbulence generator is operative to reduce vibrations having a frequency less than about 1000 Hz.

In yet another aspect of the invention, the air turbulence generator is operative to reduce vibrations having a frequency between about 200 Hz and about 500 Hz.

In accordance with yet a further aspect of the invention, the air turbulence generator is operative to reduce vibrations having a frequency between about 300 Hz and about 400 Hz.

In accordance with another specific aspect of the invention, the air turbulence generator is operative to reduce vibrations having a frequency of about 315 Hz.

In yet another aspect of the invention, a method is disclosed of providing a vehicle-mounted telematic antenna having reduced wind-generated low frequency vibrations. This method comprises the steps of providing an elongated conductor that extends in a longitudinal direction, enclosing the conductor with a shaft, providing an air turbulence generator in the form of a helical protrusion that extends outwardly from the outer surface of the shaft by a distance approximately equal to about 10% to about 20% of the diameter of the shaft, helically extending the protrusion continuously along the outer surface of the shaft in a direction generally parallel to the longitudinal direction, and providing a mounting for securing the shaft to a vehicle.

In still another aspect of the invention, the step of providing the air turbulence generator involves extending the protrusion radially outwardly from the shaft a distance equal to about 10% of the diameter of the shaft.

In yet a further aspect of the invention, the method further comprises the step of fastening the air turbulence generator to the outer surface of the shaft.

In accordance with another aspect of the invention, the air turbulence generator is provided having a substantially circular cross-sectional configuration.

In yet another aspect of the invention, the helical protrusion is integrally formed with the shaft.

In another aspect of the invention, a telematic antenna with low frequency dampening for use on a motor vehicle comprises a shaft adapted to be mounted on a vehicle, the shaft having a longitudinal axis and an outer surface, the outer surface having a configuration that surrounds and extends generally parallel to the longitudinal axis, wherein the diameter of the configuration defines the diameter of the shaft. The antenna further comprises a conductor, the conductor being substantially enclosed by the outer surface, wherein the air turbulence generator is electrically isolated from the conductor. Also comprised is an air turbulence generator in contact with the outer surface of the shaft, the air turbulence generator extending substantially continuously and helically in a direction generally parallel to the longitudinal axis, and the air turbulence generator extending radially outwardly from the outer surface of the shaft by a distance of about 10% of the diameter of the shaft, wherein the shaft and the air turbulence generator are formed integrally.

In accordance with still a further aspect of the invention, a combination of a motor vehicle with a telematic antenna is provided with a low frequency dampening comprising a shaft adapted to be mounted on the vehicle, the shaft having a longitudinal axis and an outer surface, the outer surface having a configuration that surrounds and extends generally parallel to the longitudinal axis, wherein the diameter of the configuration defines the diameter of the shaft. The antenna also comprises an air turbulence generator in contact with the outer surface of the shaft for dampening vibrations transmitted to a vehicle by the shaft, the air turbulence generator extending helically in a direction generally parallel to the longitudinal axis, and the air turbulence generator extending radially outwardly from the outer surface of the shaft by a distance greater than or equal to about 10% of the diameter of the shaft.

BRIEF DESCRIPTION OF THE DRAWINGS

The accompanying drawings, incorporated in and forming a part of the specification, illustrate several aspects of the present invention, and together with the description, serve to explain the principles of the invention in the drawings.

DESCRIPTION OF THE PREFERRED EMBODIMENTS

Figure 4:
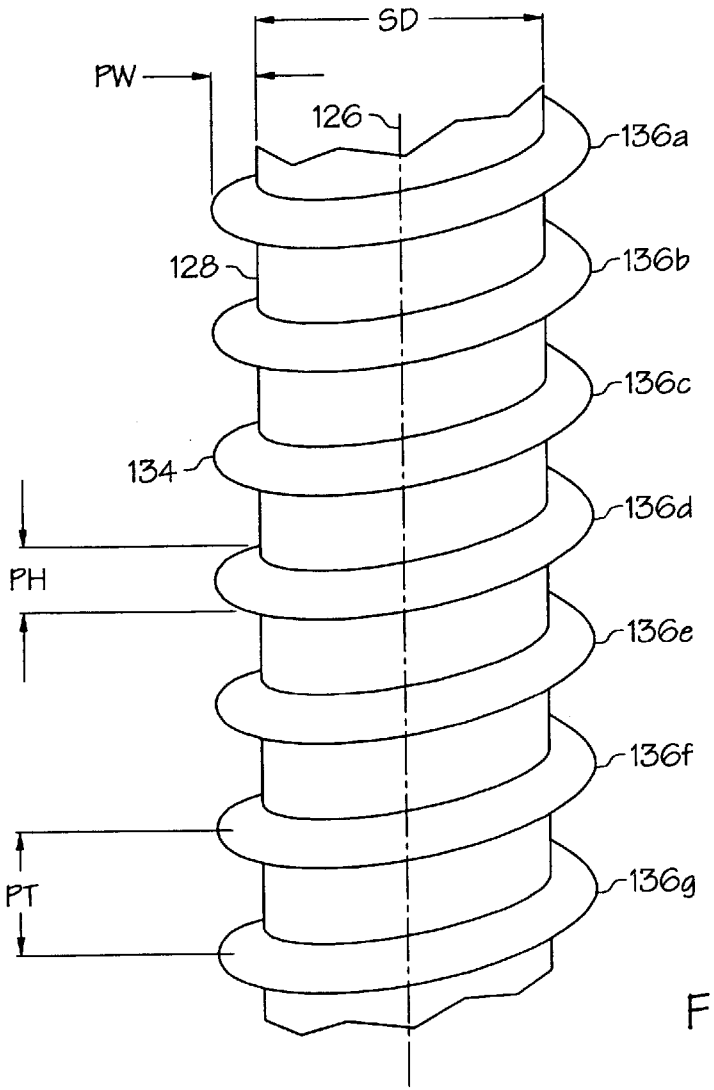
FIG. 4 is an expanded schematic diagram of a portion of the shaft of the telematic antenna of FIG. 3.
Figure 5:
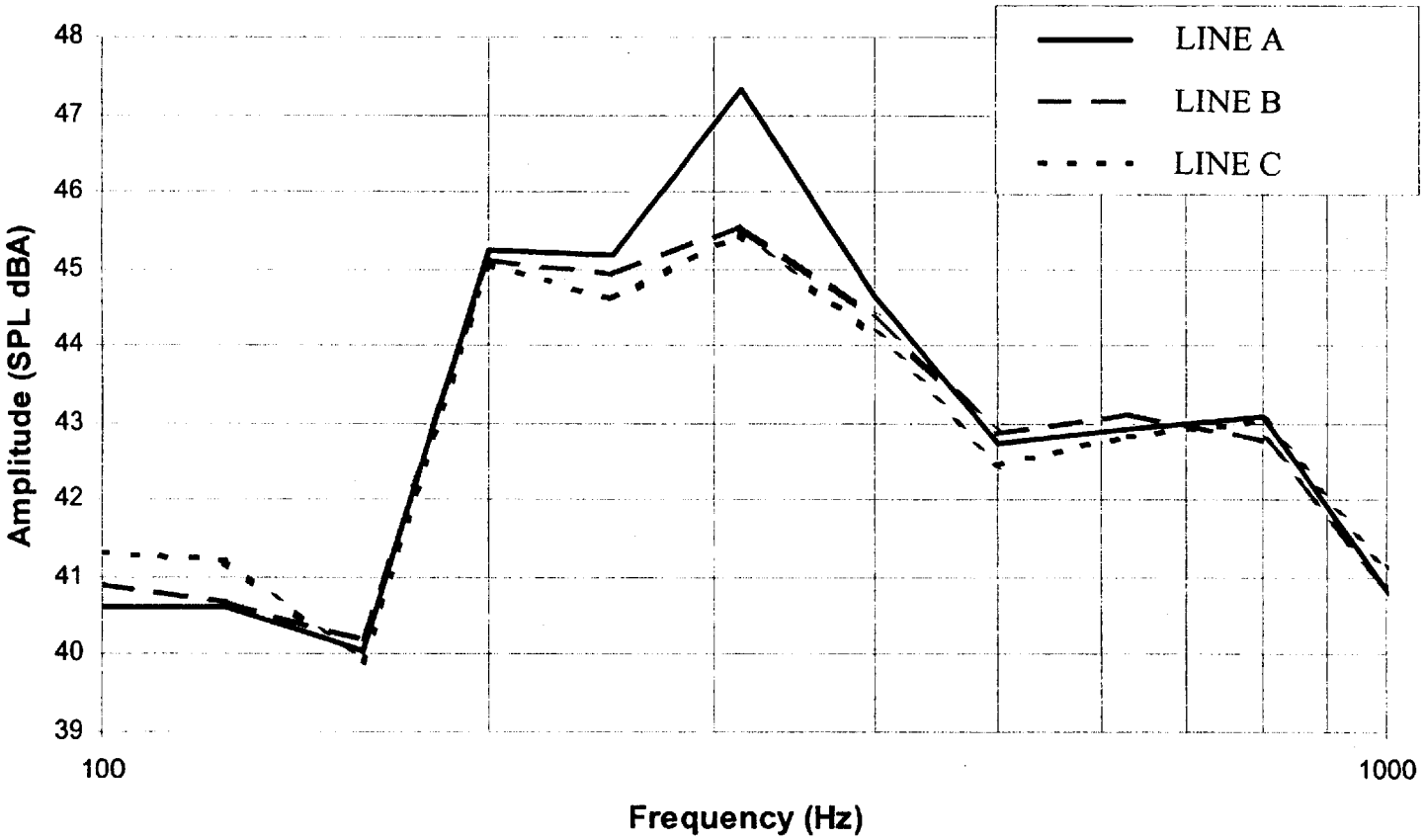
FIG. 5 is a graph comparing low frequency vibrations generated by a conventional telematic antenna and an exemplary embodiment of a telematic antenna of the present invention.

The present invention and its operation is hereafter described in detail in connection with the views of FIGS. 1–3, the schematic diagram of FIG. 4, and a comparison chart as shown by FIG. 5. A telematic antenna with an air turbulence generator is constructed in accordance with the principles of the present invention. The air turbulence generator is suitable for association with an antenna to reduce low frequency vibrations of the antenna caused by the exposure of the antenna to strong winds, such as those encountered when the antenna is affixed to a fast-moving vehicle. More particularly, the air turbulence generator is suitable for association with many different telematic antennas, such as the telematic antenna 8 shown in FIG. 1.

Figure 1:
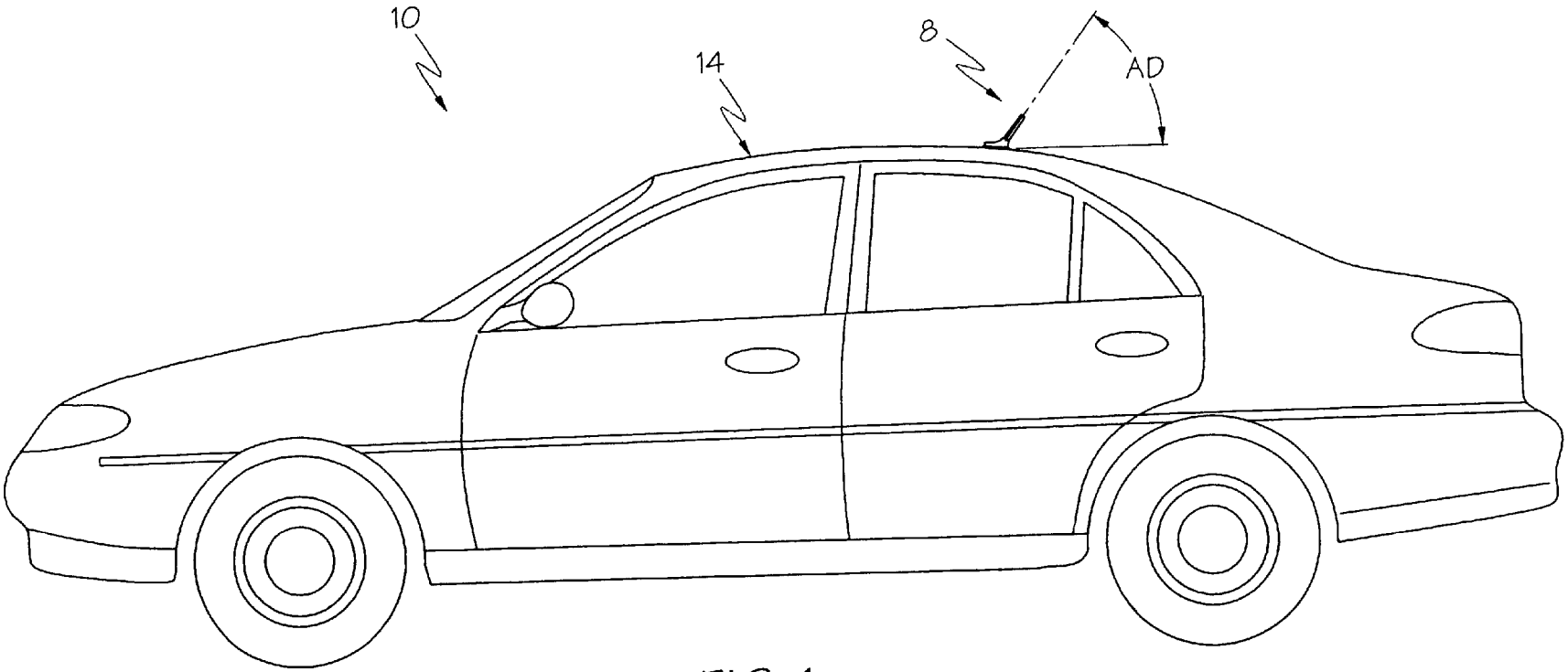
FIG. 1 is a schematic view depicting a telematic antenna mounted on an automobile.
Figure 2:
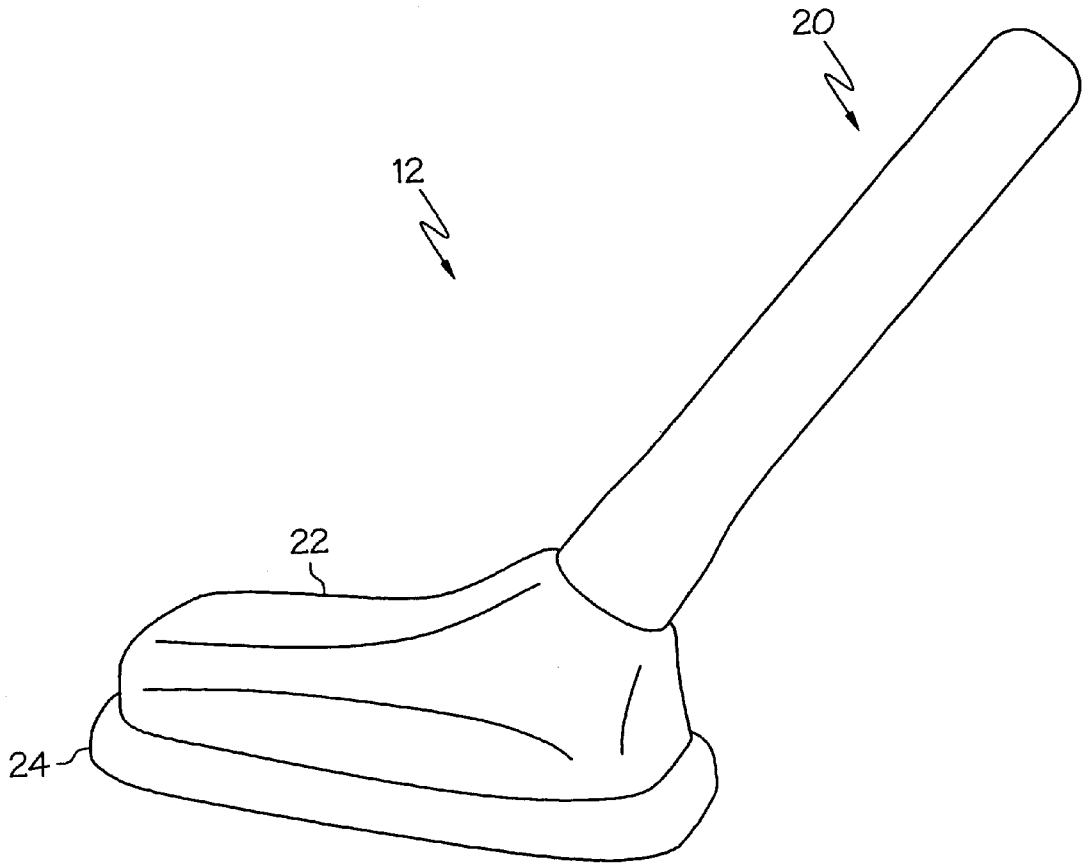
FIG. 2 (PRIOR ART)
FIG. 2 is an expanded perspective view of a conventional telematic antenna.

FIG. 1 depicts an automobile 10 having a finger-shaped telematic antenna 8 affixed to its top surface 14. FIG. 2 provides an expanded perspective view of an antenna 12, wherein antenna 12 is not modified with the teachings of the present invention, and wherein the antenna 12 is configured to be affixed to an automobile 10 in the same manner as antenna 8 in FIG. 1. The antenna 12 constitutes a shaft 20 unmodified by the present invention, a base 22, and a connector 24. The base 22 interfaces the top surface 14 of an automobile 10 by means of the connector 24. The unmodified shaft 20 affixes to the base 22 and assumes an angular disposition, labeled "AD" in FIG. 1, with respect to the top surface 14 of the automobile 10. The antenna 12 can be configured for connection to any one or combination of the automobile's 10 communication systems, such as the AM/FM radio, CB radio, two-way radio, cellular telephone, GPS system, radar detector, satellite radio, and a host of others. In an exemplary embodiment of the present invention, the antenna 12 is configured to facilitate communications of a system combining global positioning with wireless technologies to deliver personal services, including roadside and emergency assistance, remote door locking and unlocking, and concierge services, such as that advertised by the OnStar Corporation under the service mark ONSTAR. The unmodified shaft 20 of the antenna 12 may, in an exemplary embodiment of the present invention, measure approximately 80 millimeters in length and have a diameter of approximately 11 millimeters. An antenna 12 having an unmodified shaft 20 with such dimensions resonates at about 315 Hz when exposed to strong winds, such as winds traveling 80 kilometer per hour ("KPH"), and resultantly creates low frequency vibrations detectable by occupants of the automobile 10. These vibrations may be so substantial as to disrupt virtually all aspects of travel within the automobile 10, including conversations among occupants, cellular telephone conversations, radio listening, reading, sleeping, attentive driving, and others.

Figure 3:
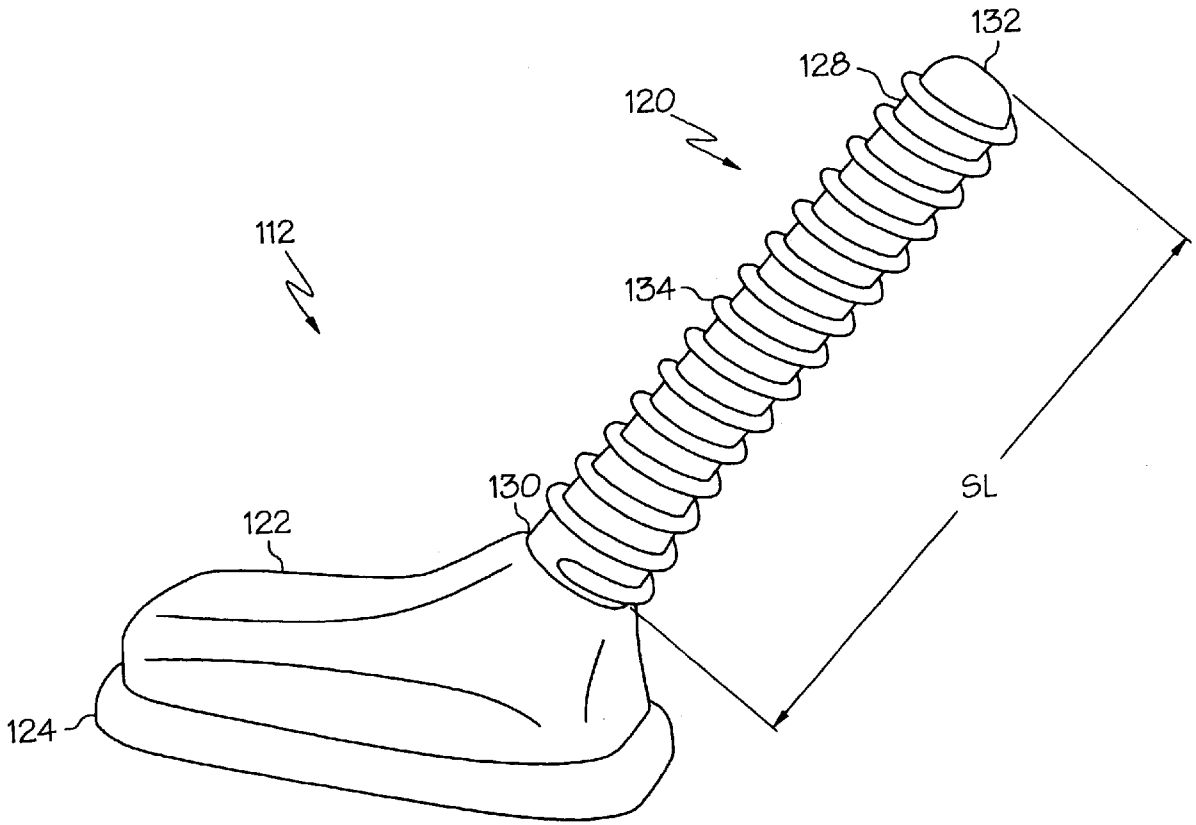
FIG. 3 is a perspective view of a telematic antenna constructed in accordance with the principles of the present invention.

FIG. 3 shows an exemplary finger-style telematic antenna 112 having a modified shaft 120 in accordance with an exemplary embodiment of the present invention, wherein the exemplary antenna 112 is configured to interface an automobile 10 in the same manner as does antenna 8 in FIG. 1. In one embodiment of the present invention, as shown in FIG. 3, the modified shaft 120 is configured to interface the base 122, wherein the base 122 is substantially identical to the base 22 used for the unmodified shaft 20 of the antenna 12. In this manner, the modified shaft 120 may replace the unmodified shaft 20 without altering the base 22, the connector 24, or any other aspect of the automobile 10. However, the configuration of the base 122 and connector 124 is substantially irrelevant and has no significant bearing upon the present invention. Likewise, the angular disposition of the modified shaft 120 with respect to the top surface 14 of the automobile 10, as exemplified by angle "AD" in FIG. 1, does not substantially affect the operation of the present invention, so long as the angle measures between about 10 degrees and about 90 degrees. Therefore, in other embodiments of the present invention, the modified shaft 120 may interface the automobile 10 using a different base or without any base whatsoever. In yet another embodiment of the present invention, the modified shaft 120 may be associated with a mechanical raising and lowering device, wherein the modified shaft 120 may be manually and/or electromechanically raised and lowered with respect to the automobile 10.

Regardless of the interface between the modified shaft 120 and the automobile 10, the modified shaft 120 may be configured for connection to any one or combination of the automobile's 10 communication systems, such as an AM/FM radio, CB radio, two-way radio, cellular/wireless telephone, GPS system, radar detector, satellite radio, and a host of others. In an exemplary embodiment of the present invention, the antenna 112 is configured to facilitate transmissions and/or receptions of an automotive communication system combining global positioning with wireless technologies.

The modified shaft 120, a portion of which is shown in the detailed schematic diagram of FIG. 4, has a longitudinal axis 126 and an outer surface 128, wherein the outer surface 128 has a generally cylindrical configuration that surrounds and extends generally parallel to the longitudinal axis 126. The outer surface 128 has a diameter labeled as "SD" on FIG. 4, which in an exemplary embodiment of the present invention is about 11 millimeters. The outer surface 128 has a length labeled as "SL" on FIG. 3 extending from the lower end 130 to the upper end 132 of the modified shaft 120 in a direction parallel to the longitudinal axis 126, which in an exemplary embodiment of the present invention measures about 80 millimeters. An electrical conductor might be present within the modified shaft 120, and more preferably would be substantially enclosed by the outer surface 128 and thus hidden from view, except perhaps at the lower end 130 of the modified shaft 120 where the conductor could protrude from the outer surface 128.

In accordance with one exemplary embodiment of the present invention, the modified shaft 120 includes a substantially continuous protrusion 134 directed radially outwardly from the outer surface 128, as shown in FIG. 3 and FIG. 4, wherein the single protrusion extends helically in a direction generally parallel to the longitudinal axis 126 of the modified shaft 120. The distance which the protrusion 134 extends radially outwardly from the outer surface 128 of the modified shaft 120 is the protrusion width and is labeled "PW" on FIG. 4. The cross-sectional diameter of the protrusion 134 in a direction normal to the protrusion width and normal to the direction of helical extension of the protrusion 134 is the protrusion height and is labeled "PH" on FIG. 4. In an exemplary embodiment of the present invention, the cross-sectional shape of the protrusion 134 is substantially circular. In another exemplary embodiment of the present invention, the cross-sectional shape of the protrusion 134 is substantially square. In yet another exemplary embodiment of the present invention, the cross-sectional shape of the protrusion 134 is substantially square but with two or more rounded corners. In an exemplary embodiment of the present invention, the protrusion width and the protrusion height remain substantially uniform throughout the entire protrusion 134.

In an exemplary embodiment of the present invention, the protrusion width is substantially equal to the protrusion height. It has been found that a protrusion width and protrusion height equal to about 10% of the diameter of the outer surface 128 of the modified shaft 120 provides optimal performance with regard to dampening low frequency vibrations of the modified shaft 120, as such a protrusion dampens problematic vibrations to a level nearly equivalent to that which would be present without any telematic antenna. Satisfactory, although reduced, performance can also be achieved when the protrusion width and protrusion height are as large as about 20% of the diameter of the outer surface 128 of the modified shaft 120. However, performance declines as the protrusion width and protrusion height are reduced below about 10% of the diameter of the outer surface 128. Also, aesthetics become unacceptable as the protrusion width and protrusion height increase above about 20% of the diameter of the outer surface 128.

In an exemplary embodiment of the present invention, both the protrusion width and the protrusion height are greater than about 10% of the diameter of the outer surface 128 of the modified shaft 120. In another exemplary embodiment of the present invention, both the protrusion width and the protrusion height are equal to between about 10% and about 20% of the diameter of the outer surface 128 of the modified shaft 120. In yet another exemplary embodiment of the present invention, both the protrusion width and the protrusion height are equal to about 10% of the diameter of the outer surface 128 of the modified shaft 120.

The helical extension of the protrusion 134 in a direction generally parallel to the longitudinal axis 126 of the modified shaft 120 results in the protrusion 134 repeatedly encircling the outer surface 128 of the modified shaft 120, thereby forming a series of windings 136*a–g*. The distance between the midpoints of the protrusion heights of two adjacent windings, such as winding 136*f* and winding 136*g*, is called the pitch, and is labeled "PT" on FIG. 4. In one exemplary embodiment of the present invention, the pitch is substantially identical with respect to all pairs of adjacent windings along the modified shaft 120. It has been found that a pitch equal to about 5 millimeters provides optimal dampening of low frequency vibrations for an exemplary telematic antenna 112 having an outer surface 128 measuring approximately 80 millimeters in length and approximately 11 millimeters in diameter. Satisfactory, although reduced, performance can be achieved through use of a 10 millimeter pitch on this exemplary antenna. However, as the pitch is significantly reduced below approximately 5 millimeters or is significantly increased above approximately 10 millimeters, the performance of the present invention with regard to this exemplary antenna significantly declines.

The outer surface 128 of the modified shaft 120 may be formed using a variety of different materials. In an exemplary embodiment of the present invention, the outer surface 128 is formed from rubberized thermoplastic, such as that sold by Advanced Elastomer Systems under the trademark SANTOPRENE. The at least one protrusion 134 from the outer surface 128 may also be formed using a variety of different materials. In one exemplary embodiment of the present invention, the protrusion 134 is formed integrally with and from the same material as the outer surface 128. For example, in an exemplary embodiment of the present invention, the outer surface 128 and the protrusion 134 are molded integrally using rubberized thermoplastic.

In another exemplary embodiment of the present invention, the protrusion 134 is manufactured using a different material than that of the outer surface 128. In this embodiment, the protrusion may comprise, for example, a flexible wire which is bent helically and placed in contact with the outer surface 128 of the modified shaft 120. This helically bent wire may be affixed to the external surface 128, if necessary, using glue, tape, heat-shrinkable tubing, mechanical means, other means, or a combination thereof. This wire may be formed from virtually any material, such as plastic, rubber, metal, another material, or a combination thereof.

In one embodiment of the present invention, the protrusion 134 is electrically isolated by the outer surface 128 from any electrical conductor present within the modified shaft 120. In another embodiment of the present invention, wherein the protrusion 134 is formed integrally with the outer surface 128, the protrusion 134 remains electrically isolated by the outer surface 128 from any electrical conductor present within the modified shaft 120.

In FIG. 5, a graph is provided to enable comparison of vibrations present within the passenger compartment of an automobile. LINE C indicates the level of vibrations present within the passenger compartment when no telematic antenna is affixed to the external surface of the automobile. LINE A indicates the increased level of vibrations within the passenger compartment when a conventional telematic antenna is affixed to the external surface of the automobile. As indicative of the benefits of an exemplary embodiment of the present invention, LINE B indicates the level of vibrations within the passenger compartment when an exemplary embodiment of a telematic antenna in accordance with the present invention is affixed to the external surface of an automobile. As is evident from this graph, a telematic antenna in accordance with an exemplary embodiment of the present invention, such as that shown in FIG. 3, significantly reduces the amplitude of low frequency vibrations that are otherwise present with a conventional telematic antenna, such as that shown in FIG. 2. The use of the telematic antenna in accordance with an exemplary embodiment of the present invention successfully reduces the vibration level to approximately that experienced by an occupant in a vehicle with no antenna. In an exemplary embodiment of the present invention, this amplitude reduction is significant at frequencies less than about 1000 Hz. In another exemplary embodiment of the present invention, this amplitude reduction is significant at frequencies between about 200 Hz and about 500 Hz. In yet another exemplary embodiment of the present invention, this amplitude reduction is significant at frequencies between about 300 Hz and about 400 Hz. In still another exemplary embodiment of the present invention, this amplitude reduction is significant at a frequencies of about 315 Hz.

In one exemplary embodiment of the present invention, a finger-style antenna is provided to facilitate transmissions and/or receptions of an automotive communication system combining global positioning with wireless technologies. The antenna constitutes a modified shaft, a base, and a connector. The base interfaces the top surface of an automobile by means of the connector and the modified shaft affixes to the base. The outer surface of the modified shaft is cylindrical and measures approximately 80 millimeters in length with a diameter of approximately 11 millimeters. The outer surface of the modified shaft includes a single protrusion having a protrusion width and a protrusion height of approximately 1.1 millimeters. This protrusion is disposed upon the outer surface of the modified shaft and extended helically so as to create windings around the modified shaft with an approximately 5 millimeter pitch. Both the outer surface and the protrusion are integrally molded from rubberized thermoplastic. When the automobile travels at high speeds or is otherwise subjected to strong winds, the protrusion generates sufficient air turbulence to prevent any problematic low frequency vibrations of the finger-shaped antenna.

In another exemplary embodiment of the present invention, a finger-style antenna is provided to facilitate transmissions and/or receptions of an automotive communication system combining global positioning with wireless technologies. The antenna constitutes an unmodified shaft, a base, and a connector. The base interfaces the top surface of an automobile by means of the connector and the unmodified shaft affixes to the base in an angular configuration with respect to the top surface of the automobile. The outer surface of the unmodified shaft is cylindrical and measures approximately 80 millimeters in length with a diameter of approximately 11 millimeters. Because the unmodified shaft is prone to creating low frequency vibrations when the automobile travels at high speeds, the unmodified shaft is removed from the base and replaced with a modified shaft. The modified shaft has an outer surface that also is cylindrical and measures approximately 80 millimeters in length with a diameter of approximately 11 millimeters. Projecting from the modified shaft's outer surface is a single protrusion having a protrusion width and a protrusion height of approximately 1.1 millimeters. This protrusion is disposed upon the outer surface of the modified shaft and extended helically so as to create windings around the modified shaft with an approximately 5 millimeter pitch. Both the outer surface and the protrusion are integrally molded from rubberized thermoplastic. When the automobile travels at high speeds or is otherwise subjected to strong winds, the protrusion generates sufficient air turbulence to prevent any problematic low frequency vibrations of the finger-shaped antenna.

In yet another exemplary embodiment of the present invention, a finger-style antenna is provided to facilitate transmissions and/or receptions of an automotive communication system combining global positioning with wireless technologies. The antenna constitutes an unmodified shaft, a base, and a connector. The base interfaces the top surface of an automobile by means of the connector and the unmodified shaft affixes to the base in an angular configuration with respect to the top surface of the automobile. The outer surface of the unmodified shaft is cylindrical and measures approximately 80 millimeters in length with a diameter of approximately 11 millimeters. Because the unmodified shaft tends to create low frequency vibrations when the automobile travels at high speeds, a protrusion is added to the outer surface. Although the outer surface is molded from rubberized thermoplastic, the protrusion is formed with stainless steel wire having a 1.1 millimeter diameter, is extended helically so as to create windings around the shaft with an approximately 5 millimeter pitch, and is held to the outer surface with an adhesive. When the automobile travels at high speeds or is otherwise subjected to strong winds, the protrusion generates sufficient air turbulence to prevent any problematic low frequency vibrations of the finger-shaped antenna.

The foregoing description of preferred embodiments of the invention has been presented for purposes of illustration and description. It is not intended to be exhaustive or to limit the invention to the forms described. Obvious modifications are possible in light of the above teachings. The embodiments were chosen and described in order to best illustrate the principles of the invention in various embodiments as are suited to the particular use contemplated. It is hereby intended that the scope of the invention be defined by the claims appended hereto.

What is claimed is:

1. A telematic antenna with low frequency dampening for use on a motor vehicle comprising:

a shaft having a longitudinal dimension and a diametrical dimension, the longitudinal dimension extending in the direction of a longitudinal axis and being less than about ten times the diametrical dimension, the longitudinal dimension terminating at a lower end of the shaft and at an upper end of the shaft, the shaft adapted to be mounted on a vehicle and having an outer surface, the outer surface surrounding the longitudinal axis and extending generally parallel to the longitudinal axis along the entire longitudinal dimension of the shaft;

a conductor, the conductor being substantially enclosed by the outer surface; and an air turbulence generator in contact with the outer surface and including a protrusion, the air turbulence generator operative to damp vibrations having a frequency less than about 1000 Hz transmitted to a vehicle surface by the shaft, the air turbulence generator extending helically and substantially continuously in a direction generally parallel to the longitudinal axis along substantially the entire longitudinal dimension of the shaft, the air turbulence generator extending radially outwardly from the outer surface of the shaft by a distance greater than or equal to about 10% of the diametrical dimension.

2. The telematic antenna of claim 1, wherein the air turbulence generator extends radially outwardly from the outer surface of the shaft by a distance between about 10% and about 20% of the diametrical dimension.

3. The telematic antenna of claim 1, wherein the air turbulence generator extends radially outwardly from the outer surface of the shaft by a distance of about 10% of the diametrical dimension.

4. The telematic antenna of claim 1, wherein the cross-sectional diameter of the air turbulence generator in a direction normal to the radial extension of the air turbulence generator and normal to the helical extension of the air turbulence generator is substantially equal to the distance of radial extension by the air turbulence generator outward from the shaft.

5. The telematic antenna of claim 1, wherein the helical projection of the air turbulence generator defines a plurality of windings of the air turbulence generator around the shaft, wherein the distance between the cross-sectional centers of two adjacent windings defines the pitch.

6. The telematic antenna of claim 5, wherein said pitch is substantially uniform among all adjacent windings of the air turbulence generator.

7. The telematic antenna of claim 6, wherein the pitch is between about 5 millimeters and about 10 millimeters.

8. The telematic antenna of claim 7, wherein the pitch is about 5 millimeters.

9. The telematic antenna of claim 1, wherein the air turbulence generator is integral with the shaft.

10. The telematic antenna of claim 1, wherein the configuration is generally cylindrical.

11. The telematic antenna of claim 1, wherein the air turbulence generator is electrically isolated from the conductor.

12. The telematic antenna of claim 1, wherein the air turbulence generator is operative to reduce vibrations having a frequency between about 200 Hz and about 500 Hz.

13. The telematic antenna of claim 12, wherein the air turbulence generator is operative to reduce vibrations having a frequency between about 300 Hz and about 400 Hz.

14. The telematic antenna of claim 13, wherein the air turbulence generator is operative to reduce vibrations having a frequency of about 315 Hz.

15. A method of providing a vehicle-mounted telematic antenna having reduced wind-generated low frequency vibrations, comprising the steps of:

providing an elongated conductor that extends in a longitudinal direction along a longitudinal axis;

enclosing the conductor with a shaft, the shaft having a longitudinal dimension and a diametrical dimension, the longitudinal dimension extending in the longitudinal direction and being less than about ten times the diametrical dimension, the longitudinal dimension terminating at a lower end of the shaft and at an upper end of the shaft, the shaft including an outer surface surrounding the longitudinal axis and extending generally parallel to the longitudinal axis along the entire longitudinal dimension of the shaft;

providing an air turbulence generator in the form of a protrusion that extends outwardly from the outer surface of the shaft by a distance approximately equal to about 10% to about 20% of the diametrical dimension, and helically extending the protrusion substantially continuously in a direction generally parallel to the longitudinal axis along substantially the entire longitudinal dimension of the shaft, wherein the protrusion is operative to damp vibrations having a frequency less than about 1000 Hz transmitted to a vehicle surface by the shaft; and providing a mounting for securing the shaft to a vehicle.

16. The method of claim 15, wherein the step of providing the air turbulence generator involves extending the protrusion radially outwardly from the shaft a distance equal to about 10% of the diametrical dimension.

17. The method of claim 15, further comprising a step of fastening the air turbulence generator to the outer surface of the shaft.

18. The method of claim 15, wherein the air turbulence generator is provided having a substantially circular cross-sectional configuration.

19. The method of claim 15, wherein the helical protrusion is integrally formed with the shaft.

20. A telematic antenna with low frequency dampening for use on a motor vehicle comprising:

a shaft adapted to be mounted on a vehicle, the shaft having a longitudinal dimension and a diametrical dimension, the longitudinal dimension extending in the direction of a longitudinal axis and being less than about ten times the diametrical dimension, the longitudinal dimension terminating at a lower end of the shaft and at an upper end of the shaft, the shaft including an outer surface, the outer surface surrounding the longitudinal axis and extending generally parallel to the longitudinal axis along the entire longitudinal dimension of the shaft;

an air turbulence generator in contact with the outer surface of the shaft and including a protrusion, the air turbulence generator operative to damp vibrations having a frequency less than about 1000 Hz transmitted to a vehicle surface by the shaft, the air turbulence generator extending substantially continuously and helically in a direction generally parallel to the longitudinal axis along substantially the entire longitudinal dimension of the shaft, the air turbulence generator extending radially outwardly from the outer surface of the shaft by a distance of about 10% of the diametrical dimension, wherein the shaft and the air turbulence generator are formed integrally; and a conductor, the conductor being substantially enclosed by the outer surface, wherein the air turbulence generator is electrically isolated from the conductor.

21. In combination with a motor vehicle, a telematic antenna with low frequency dampening comprising:

a shaft adapted to be mounted on the vehicle, the shaft having a longitudinal dimension and a diametrical dimension, the longitudinal dimension extending in the direction of a longitudinal axis and being less than about ten times the diametrical dimension, the longitudinal dimension terminating at a lower end of the shaft and at an upper end of the shaft, the shaft having an outer surface, the outer surface surrounding the longitudinal axis and extending generally parallel to the longitudinal axis along the entire longitudinal dimension of the shaft; and an air turbulence generator in contact with the outer surface of the shaft and operative to dampen vibrations having a frequency less than about 1000 Hz transmitted to a vehicle surface by the shaft, the air turbulence generator extending helically and substantially continuously in a direction generally parallel to the longitudinal axis along substantially the entire longitudinal dimension of the shaft, the air turbulence generator extending radially outwardly from the outer surface of the shaft by a distance greater than or equal to about 10% of the diametrical dimension.

* * * * *